US010252288B2

(12) United States Patent
Wadkins

(10) Patent No.: US 10,252,288 B2
(45) Date of Patent: Apr. 9, 2019

(54) PARTICULATE-INCORPORATING ATTACHMENT FOR A DROP SPREADER

(71) Applicant: Joe Dennis Wadkins, Las Vegas, NV (US)

(72) Inventor: Joe Dennis Wadkins, Las Vegas, NV (US)

( * ) Notice: Subject to any disclaimer, the term of this patent is extended or adjusted under 35 U.S.C. 154(b) by 190 days.

(21) Appl. No.: 15/464,315

(22) Filed: Mar. 20, 2017

(65) Prior Publication Data

US 2018/0264511 A1 Sep. 20, 2018

(51) Int. Cl.

| | |
|---|---|
| ***A46B 17/02*** | (2006.01) |
| ***B05C 19/00*** | (2006.01) |
| ***B05C 19/04*** | (2006.01) |
| ***B05C 11/02*** | (2006.01) |
| ***E01C 19/20*** | (2006.01) |
| *E01C 13/08* | (2006.01) |

(52) U.S. Cl.
CPC ..... *B05C 19/008* (2013.01); *B05C 11/023* (2013.01); *B05C 19/04* (2013.01); *E01C 19/20* (2013.01); *E01C 13/08* (2013.01)

(58) Field of Classification Search
CPC ..... B05C 19/008; B05C 19/04; B05C 11/023; B05C 11/021; E01C 19/20; E01C 13/08
USPC ..... 239/661, 671
See application file for complete search history.

(56) References Cited

U.S. PATENT DOCUMENTS

| | | | | |
|---|---|---|---|---|
| 8,028,928 | B2 * | 10/2011 | Detweiler | A01N 25/08 239/214.25 |
| 8,376,250 | B2 | 2/2013 | Conner et al. | |
| 8,490,897 | B1 * | 7/2013 | Magnus | E01C 19/2005 222/242 |
| 2006/0006256 | A1 | 1/2006 | Smith et al. | |

FOREIGN PATENT DOCUMENTS

| | | | | |
|---|---|---|---|---|
| KR | 20110077809 A | * | 7/2011 | E01C 19/2005 |

* cited by examiner

*Primary Examiner* — Jennifer C Chiang
(74) *Attorney, Agent, or Firm* — Connie R. Masters

(57) ABSTRACT

A particulate-incorporating attachment for a drop spreader is provided that includes a two-portion mount bracket, an implement holder, and a rake/brush. The bracket portions are connected to form a mount bracket over the rest brace of the drop spreader. The mount bracket mounts or carries the implement holder, which supports the rake/brush in a suitable position to assist in the incorporation of infill material into the space between the grass tufts of synthetic turf or to assist in the incorporation of other dropped particulates into synthetic or natural turf or onto the ground.

20 Claims, 9 Drawing Sheets

PARTICULATE-INCORPORATING ATTACHMENT FOR A DROP SPREADER

FIELD OF INVENTION

This invention relates generally to manual outdoor turf equipment and, more particularly, to a particulate-incorporating attachment for a manual drop spreader suitable for use in incorporating particles dispensed by the drop spreader, particularly during the filling of synthetic turf spaces with infill material.

BACKGROUND

Replacing grass with artificial or synthetic turf provides several advantages, such as greatly reducing the need for lawn maintenance and eliminating the use of water for lawn irrigation. Synthetic turf is typically fabricated with an upward-facing synthetic green grass face formed by tufts of grass and a downward-facing backing or understructure that supports the synthetic tufts of the grass face. The grass tufts may include additional thatch tufts. Tuft spaces, which are disposed between the grass tufts, typically receive an infill material during installation of the synthetic turf.

To install the synthetic turf, the turf area is prepared, and then one or more sections of synthetic turf are joined to cover the turf area. In most installation, the final step is to apply the infill. The infill is used to support the grass filaments and tuffs, to add dimensional stability, to provide a more realistic appearance, and/or to increase safety for sports players using a turf sports field.

Different types of infill are available to meet the requirements of the particular installation. Silica sand may be used in low traffic areas. A rubber and sand mixture may be used on medium traffic areas and commercial installations. Particulate or pelletized rubber or "crumb rubber" (which may be derived from scrap, recycled vehicle tires) is often used for synthetic turf sports fields to provide shock absorption, to enhance traction, to add ballast, and to protect the players from injury. For example, sports organizations require the hardness of sports fields to be less than 200 Gmax, which is achieved by using pelletized rubber. Other infill combinations and variations are available, such as acrylic-coated silica sand, organic mineral infill, and various elastomer infills.

For large synthetic turf fields, such as sports fields, tractors may spread the infill and pull a rear-attached powered brushing or raking attachment to level the infill and to incorporate it into the spaces between the tufts. However, in lawns and other smaller areas a manually-powered drop spreader is commonly used to apply the infill material (typically 1-2 pounds per square foot) onto the turf. The infill material is placed inside the drop spreader bucket, the dispenser gauge is set appropriately, and multiple passes are made to achieve an even distribution. Between each pass the synthetic grass fibers are manually brushed with a stiff bristled industrial broom, carpet rake, power broom, or the like to incorporate the infill into the synthetic turf. The dispensing and brushing steps are repeated until the infill material is evenly spread and incorporated to the prescribed depth.

This standard method of infill installation is less than desirable, because of the time and labor required for each of the manual infill dispensing steps and the separate manual infill brushing steps. Accordingly, there is a need for a device and method of use that will reduce the time and labor required during installation of turf infill.

BRIEF SUMMARY OF THE INVENTION

The present invention is directed to a particulate-incorporating attachment for a manual drop spreader that includes a two-portion mount bracket with an appended or integral implement holder that supports a rake/brush. The mount bracket is manually attachable to a rearward rest brace of the drop spreader in a manner to support and position the rake/brush in a suitable position for incorporating the infill into the turf spaces of synthetic turf or otherwise incorporating dispensed particulates.

The mount bracket includes a proximal bracket portion and a distal bracket portion, which are joined together over, and supported by, the rearwardly and downwardly extending rest brace of the drop spreader. The mount bracket supports the implement holder to hold it securely in a position suitable for raking or brushing the infill into the synthetic turf. In one the implement holder has a channel that is configured to receive the removable or non-removable rake/brush. In another aspect, the implement holder and rake/brush are formed integrally.

Also disclosed are methods of attaching the particulate-incorporating attachment to the drop spreader and methods of using the particulate-incorporating attachment for installation of infill into synthetic turf or for incorporation of other spreader-dispensed particulates.

In one aspect of the present invention, the two mount bracket portions are formed of C-shaped pieces.

In another aspect of the present invention, the two mount bracket portions are formed of L-shaped pieces.

In a further aspect of the present invention, the channel may form a ninety-degree angle with the flat panel of the implement holder.

In another aspect of the present invention, the channel may form an angle with the flat panel of the implement holder that is greater than ninety degrees.

In a further aspect of the present invention, the implement holder may be less than half the height of the mount bracket portions.

In another aspect of the present invention, the implement holder may be substantially the height of the mount bracket portions.

In a further aspect of the present invention, the implement holder may be formed integrally with a portion of the mounting bracket.

In an additional aspect of the present invention, the brush/rake may be formed integrally with the implement holder.

An object of the present invention is to provide a particulate-incorporating attachment for a drop spreader that can be used to aid in incorporating infill into synthetic turf.

This and other objects, features, and advantages of the present invention will become more readily apparent from the attached drawings and from the detailed description of the preferred embodiments which follow.

BRIEF DESCRIPTION OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 1:
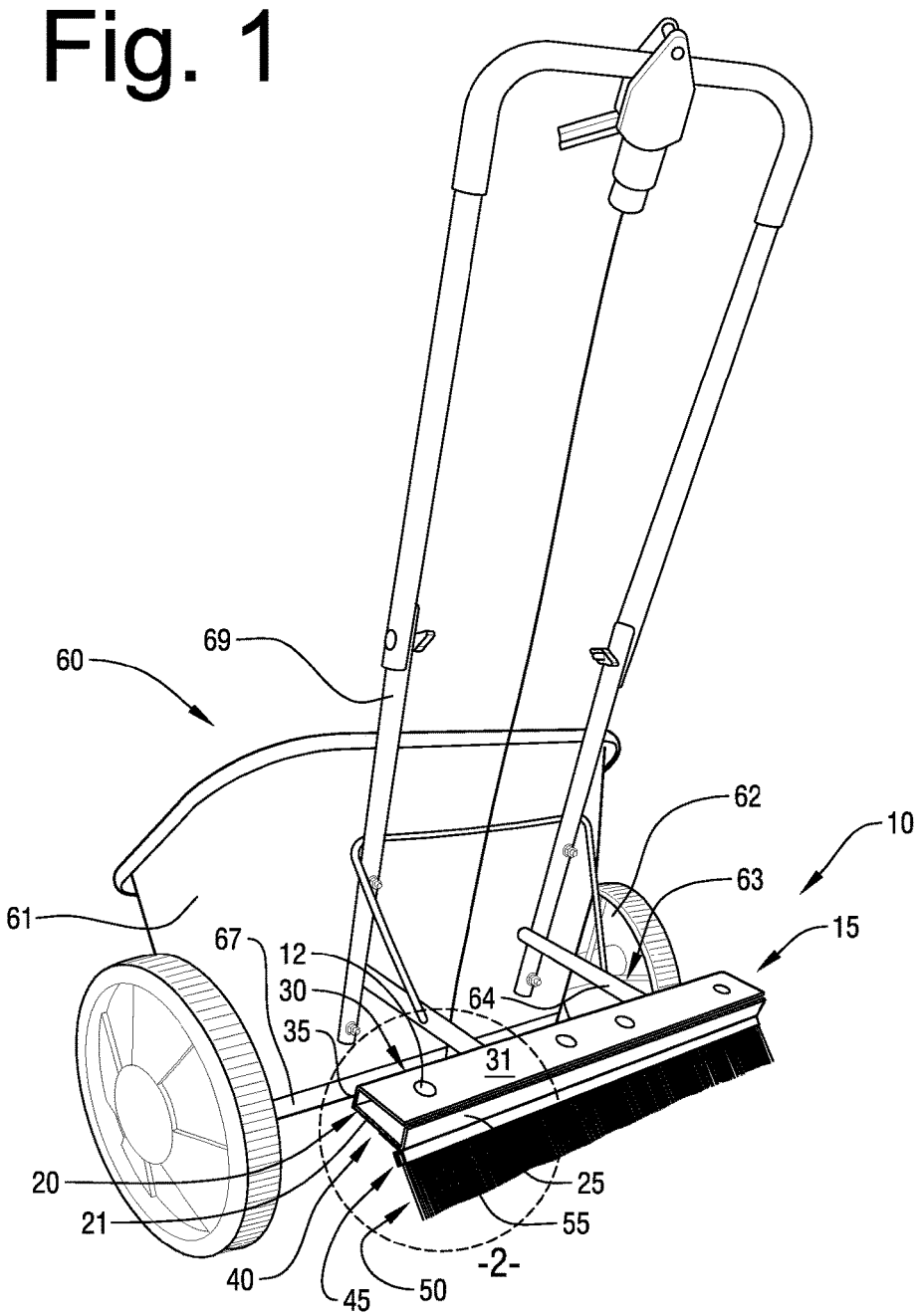
FIG. 1 is a perspective view of the first embodiment of the particulate-incorporating attachment of the present invention in its environment of use, which is attached to a manual drop spreader.

Shown throughout the figures, the present invention is directed toward a particulate-incorporating attachment 10 for a manual drop spreader 60 and methods of utilizing the particulate-incorporating attachment 10 to spread and/or incorporate infill into synthetic turf and/or to spread, smooth, or level other particulates dispensed by the drop spreader 60. The particulate-incorporating attachment 10 may suitably comprise a two-part mount bracket 15, a rake/brush 50, and an implement holder 40.

The mount bracket 15 mounts the rake/brush 50 at an appropriate angle and position for performing the functions of smoothing, leveling, spreading, integrating, and/or incorporating the spreader-dispensed particulates. The mount bracket 15 attaches around, and is supported by, the spreader's rest brace 63, which extends downwardly from the spreader handle 69 behind or rearward of the spreader bucket 61.

The two-portion mount bracket 15 comprises at least a distal panel 31, a proximal panel 21, an upper flange 35, a lower flange 25, and a means to connect the mount bracket 15 to or around the spreader rest brace 63. The upper flange 35 is configured with a right and left set of notch edges 37 that define right and left upper flange notches 36. The right and left sides of the spreader rest brace 63 are received into these right and left notches 36, respectively, and held there when the particulate-incorporating attachment 10 is in use. For purposes of description herein, the terms "proximal" and "distal" and derivatives thereof shall relate to the proximity to the rear of the bucket 61 of the drop spreader 60; the term "incorporating" and derivatives thereof shall include one or more of the functions of smoothing, leveling, spreading, integrating, or incorporating; and the terms "upper", "lower", "rear" or "rearward," "front" or "forward," "left," "right," "vertical", "horizontal", and derivatives thereof shall relate to the invention as oriented when in use by a user with the rake/brush 50 directed downward toward the synthetic grass, natural grass, or ground.

The mount bracket 15 comprises a proximal bracket portion 20 and a distal bracket portion 30, which are manually connectable around the spreader's rest brace 63. Attached to, or formed integrally with, one of the two bracket portions 20, 30 is the implement holder 40, which removably or non-removably secures the rake/brush 50 to the mount bracket 15.

The bracket portions 20, 30 are configured to be combined around the rest brace 63, which is rearward of the drop spreader bucket 61. Due to the positioning of the mount bracket 15 around the lower portion of the rear rest brace 63, the rake/brush 50 (supported by the mount bracket 15 and implement holder 40) is positioned behind or rearward of the bottom opening 67 of the spreader bucket 61 and is carried forward behind the bucket 61 when the spreader wheels 62 turn propelled by manual power. Therefore, as the particulates are dispersed onto the grass by the normal action of the drop spreader 60, they are immediately brushed or raked into the grass and incorporated.

The mount bracket 15 and rake/brush 50 may be constructed and arranged in various suitable configurations that meet the present invention's requirements of using the spreader's rest brace 63 for supporting the mount bracket 15 and using the mount bracket 15 to hold or support the rake/brush 50 in the proper position to brush or rake spreader-dropped particulates along or into the synthetic grass (or, in other environments of use, the natural grass or the ground). To illustrate these suitable configurations, three exemplary embodiments with multiple aspects are presented.

Figure 2:
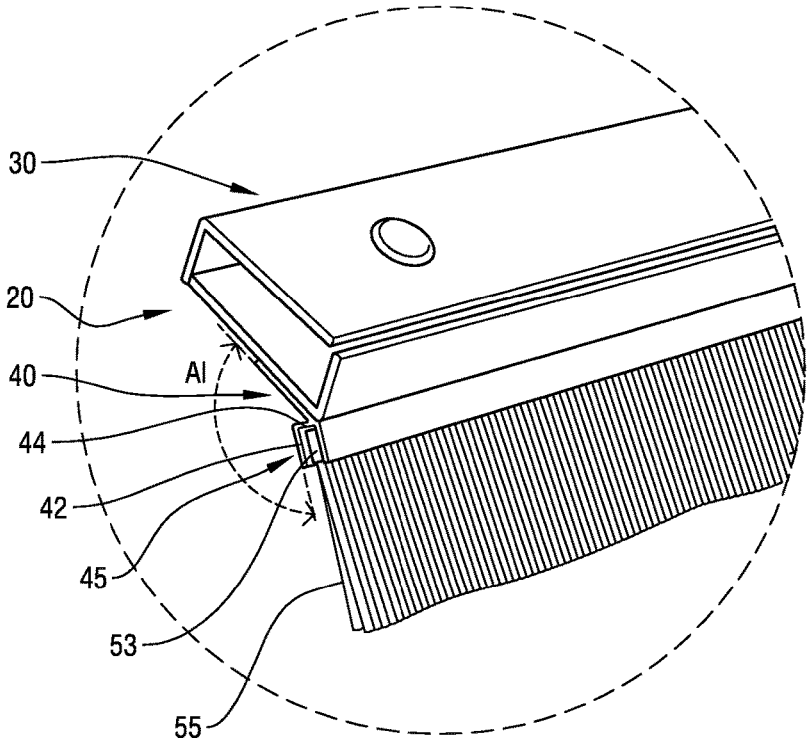
FIG. 2 is a detail view taken from circle -2- of FIG. 1 illustrating the mount bracket portions, implement holder, and rake/brush of the first embodiment of the present invention.

In the first exemplary embodiment, shown in FIGS. 1-2, the proximal bracket portion 20 and distal bracket portion 30 are both L-shaped, as can best be seen in the detail view of FIG. 2. The implement holder 40 is removably attached to the proximal bracket portion 20. The implement holder 40 includes a flat panel 49 and a channel 45 for permanently receiving a removable or non-removable rake/brush 50.

The distal bracket portion 30 comprises a distal bracket forward panel 31 and a distal bracket upper flange 35. The distal bracket upper flange 35 extends along the longitudinal length of the panel 31 at a substantially ninety-degree angle, together forming the L-shape. The distal bracket panel 31 is a flat metal plate configured with hole edges defining a set of holes 38 that are used to connect the two bracket portions 20, 30.

Figure 4:
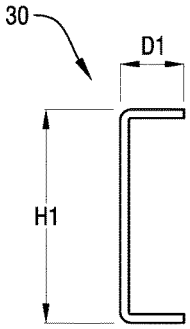
FIG. 4 is an end view of the distal bracket portion of the second embodiment of the present invention.
Figure 5:
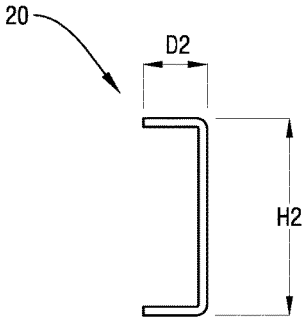
FIG. 5 is an end view of the proximal bracket portion of the second embodiment of the present invention.
Figure 8:
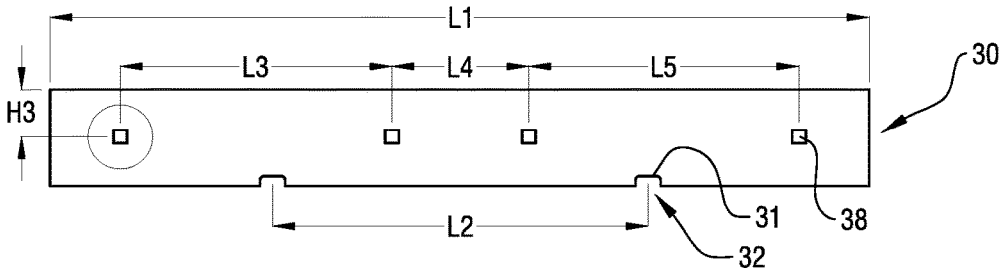
FIG. 8 is a front view of the distal bracket portion of the second embodiment of the present invention.
Figure 9:
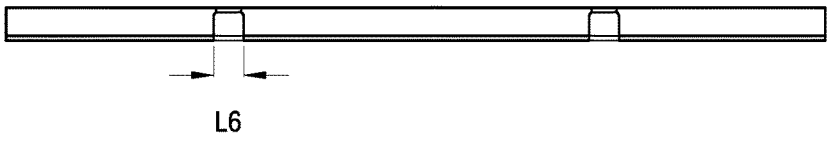
FIG. 9 is a top view of the distal bracket portion of the second embodiment of the present invention.

Though the distal bracket upper flange 35 may be formed separately and attached to the panel 31, preferably the flange 35 is formed integrally with the panel 31. Preferably, a single sheet of metal (a flat metal blank) is used that has a width (bend allowance+D1+H1, where D1 and H1 are shown in the illustration of the second embodiment of FIG. 4) suitable to form both the flange 35 and the panel 31 and that has a length (L1, shown in the illustration of the second embodiment of FIG. 8) suitable for use with the particular model of drop spreader 60 for which the attachment 10 is designed. In an aspect, the flange 35 may be formed by bending the metal blank at a substantially ninety-degree angle to create the flange 35 along one longitudinal side of the panel 31.

Before bending, the section of the metal blank that will form the distal bracket upper flange 35 is configured with two sets of distal bracket upper flange notch edges 37 that define the flange notches 36. The flange notches 36 are spaced and sized to accommodate the extending arms 64 of the rest brace 63. The flange 35 has a depth D1 (FIG. 4) that is approximately equal to or slightly smaller than the diameter of the rest brace arms 64 to allow the rest brace arms 64 and cross member 65 to be installed into the interior space of the two-part bracket and held securely or clamped by the action of the fasteners 12 between the proximal bracket portion 20 and the distal bracket portion 30.

The metal blank from which the distal bracket flange 35 and forward panel 31 are formed has a length L1 (FIG. 8) which is significantly greater than the distance between the rest brace extending arms 64, so that a portion of the distal bracket portion 30 extends on both the left and right sides beyond the rest brace extending arms 64 that are received within flange notches 36.

The proximal bracket portion 20 is formed and configured similarly to the distal bracket portion 30. It comprises a proximal bracket lower flange 25 that extends longitudinally at a substantially ninety-degree angle along the longitudinal length of a proximal bracket panel 21. The proximal bracket portion 20 is substantially the same length as the distal bracket portion 30 to which it is removably connectable. As with the distal bracket portion 30, in the proximal bracket portion 20 the flange 25 is preferably formed integrally with the panel 21 from a metal blank, though they may be formed separately and permanently joined. The bending of the bracket portions 20, 30 may be accomplished by using any of the known metal bending fabrication techniques to create the substantially ninety-degree angle between the flanges 25, 35 and panels 21, 31.

The proximal bracket portion 20 is configured with hole edges defining a set of holes 28 that correspond to the set of distal bracket holes 38. After insertion of the spreader rest brace 63 into the flange notches 36 (illustrated in FIG. 10, in the discussion of the second embodiment) the proximal bracket portion 20 is attached with fasteners 12, such as carriage bolts, to the distal bracket portion 30 via the aligned, corresponding sets of holes 28, 38 to form the completed mount bracket 15.

The implement holder 40 is a metal panel extending substantially the length of the distal bracket portion 30 that attaches adjacent to the proximal bracket portion 20. (In another aspect, the implement holder 40 is optionally formed integrally with the proximal bracket portion 20.) The implement holder 40 may be attached to the outer side of the proximal bracket portion 20 before forming the completed mount bracket 15 or may be attached to the completed mount bracket 15.

In the aspect shown in FIGS. 1-3, 6, 11-12, the implement holder 40 includes a channel 45 for receiving the rake/brush 50. The channel 45 may have a base 44 (FIG. 2) and opposing extending arms 42 disposed at the longitudinal edges of the base 44. The base 44 and arms 42 are sized and shaped to accommodate the binding 53 of the rake/brush 53 and to hold it securely. The arms 42 may end in an inward projection 43 (FIG. 6) or may angle inward to hold the rake/brush 53 firmly in place while in use. In one aspect shown in FIGS. 1-2, the channel is attached at an angle A (A1 of FIG. 2) between the back of the channel and the panel of the implement holder, which is greater than ninety degrees. In another aspect shown in FIG. 6, the channel 45 is attached at an angle A (A2 of FIG. 6) at substantially ninety degrees. To allow the particulate-incorporating attachment 10 to be attached to varying brands and types of drop spreaders, the angle A between the channel 45 and the panel 21 may vary between 80 to 190 degrees.

Figure 3:
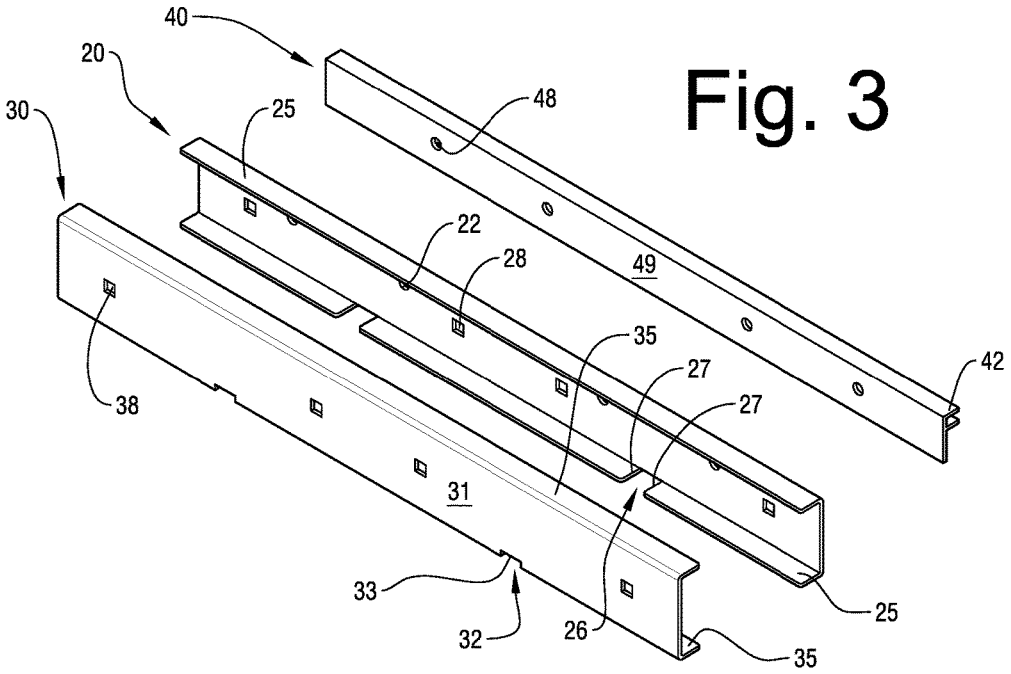
FIG. 3 is an exploded view of the two mount bracket portions and an aspect of the implement holder of the preferred second embodiment of the present invention.

In one aspect of the invention seen in FIG. 3, the proximal bracket portion 20 includes bracket holes 22, and the implement holder 40 is attached to the proximal bracket portion 20 via implement holder holes 48 that correspond to bracket holes 22. The cutouts defining the implement holder holes 48 may be generally centered vertically within the vertical panel of the implement holder 40. The corresponding cutouts defining the bracket holes 22 are not centered vertically within the panel of the proximal bracket portion 20, but are generally centered on the downward facing half of the proximal bracket portion 20. (Note that the exploded view of FIG. 3 shows the pieces with the bottom of the brackets 20, 30 and implement holder upward, the opposite of the orientation of FIG. 1.) In these embodiments, the implement holder 40 is less than half the height of the proximal bracket portion 20 so is attached below the corresponding sets of holes 28, 38. However, in another preferred aspect of the invention shown in FIG. 12, the implement holder 40 has a greater height and is configured with holes 48 that correspond to the sets of holes 28, 38 of the two bracket portions, so holes 28, 38, 48 are aligned and receive fasteners 12, thereby reducing the work of assembly of the attachment 10.

Figure 11:
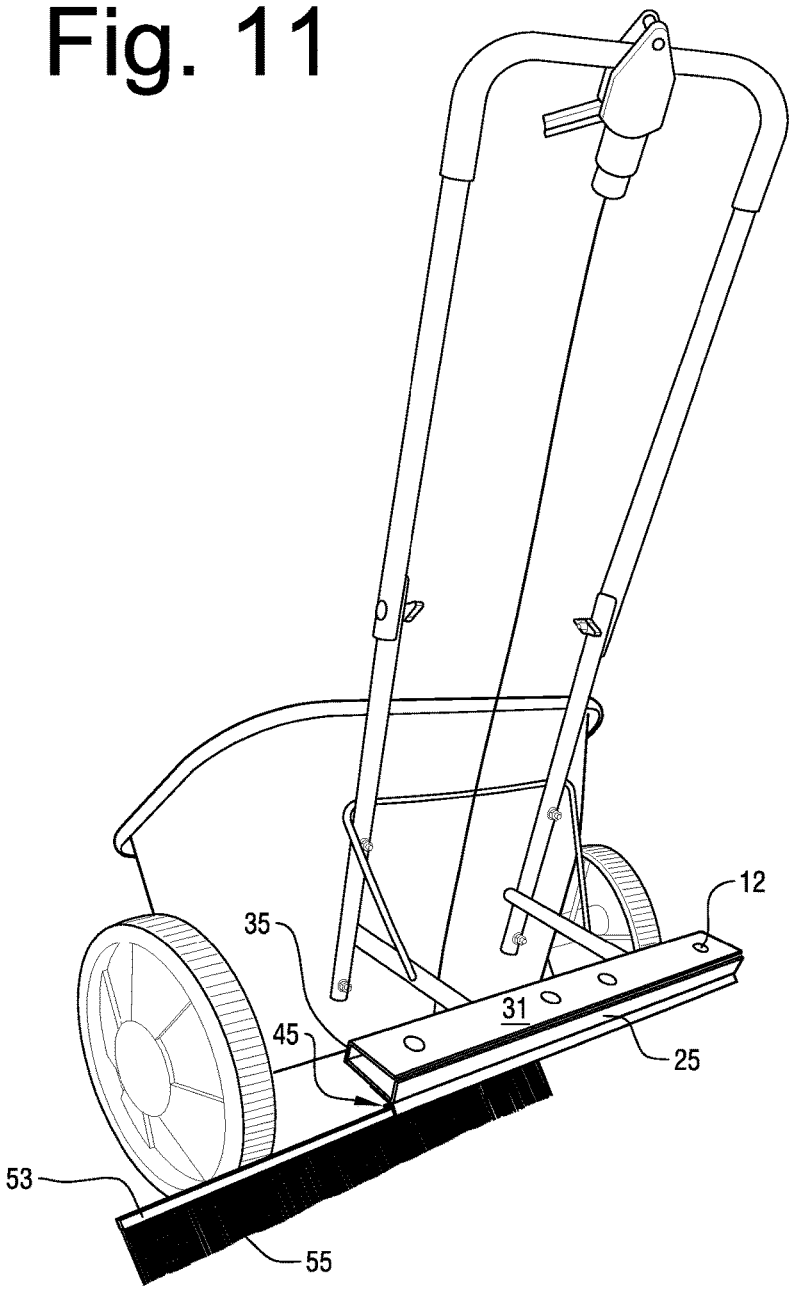
FIG. 11 is a perspective view illustrating insertion of the rake/brush into the implement-receiving channel of the implement holder, shown with the mounting bracket of the first embodiment of the present invention.
Figure 12:
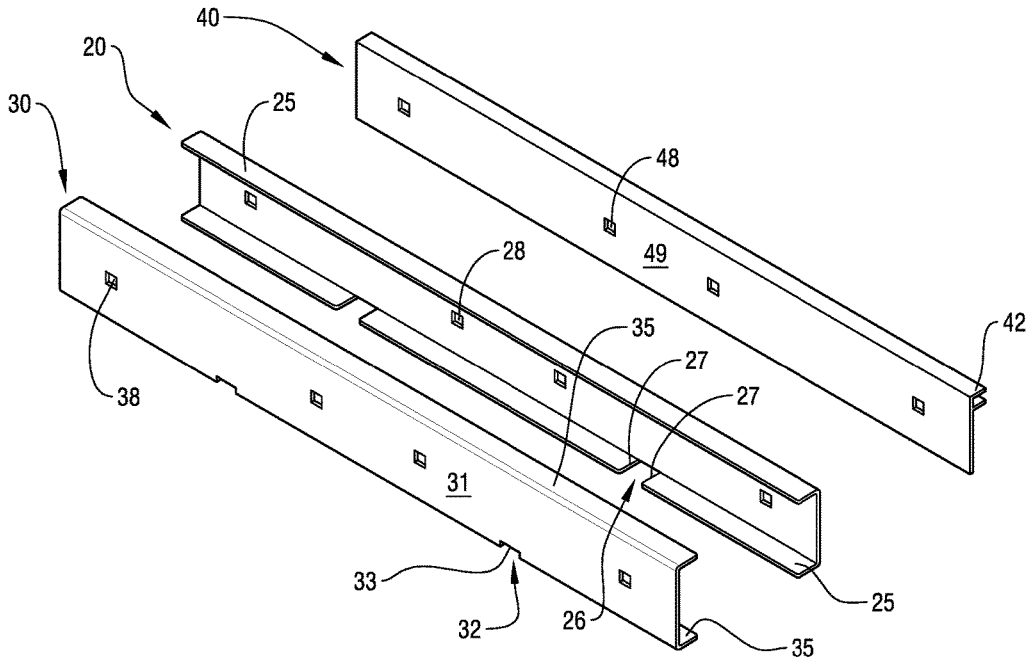
FIG. 12 is an exploded view of the two mount bracket portions and a second aspect of the implement holder of the preferred second embodiment of the present invention.

The implement holder 40 supports the channel 45 into which the rake/brush 50 is received, as seen in FIG. 11. The channel preferably runs substantially the length of the implement holder 40, but multiple channel portions that each extend a portion of the length of the implement holder 40 may optionally be used to hold the rake/brush 50. In the aspect shown in FIG. 11, the rake/brush 50 is removable from the implement holder 40 and is replaceable when worn. In another aspect, the rake/brush 50 is non-removable from the channel 45 of the implement holder 40, but, instead, is fixedly attached via a securing means, such as by glue or adhesives or by screws, bolts or other hardware. In another aspect, shown in the third embodiment of FIGS. 13-14, the implement holder 40 and the rake/brush 50 are formed integrally. In the aspects in which the rake/brush 50 is fixedly attached within the implement holder channel 45 or formed integrally with the implement holder 40, if the rake/brush 50 becomes worn and unusable, the joined implement holder 40 and rake/brush 50 combination can be removed and replaced.

The rake/brush 50 comprises a fill (projections 55) and a binding 53. In the first and second embodiments, the projections 55 comprise bristles, which are filaments that may be formed of synthetic materials or of metal, whereas in the third embodiment of FIGS. 13-14, the projections 55 comprise straight or curved metal tines, which have a width greater than the width of the bristles. Synthetic materials include man-made fibers including nylon, polyester, polypropylene, and the like. Metal bristles include both straight and twisted wire of stainless steel, high carbon steel, brass, or the like. Twisted or crimped nylon bristles are preferred due to the characteristics of the nylon material, which include high durability, high abrasion resistance, non-shedding, and excellent bend recovery. The trim may be flat, beveled, or off-set, but a flat trim is preferred. The trim length L9 (FIG. 6), the length of the exposed filament, may vary from 1 inches to 10 inches, but in a specific design aspect for a specific drop spreader is preferably 1 to 2 inches.

The binding 53 (FIGS. 6-7) secures or binds the bristles together. The binding 53 may be metal or a man-made material. Preferably the binding 53 is formed of metal and holds the upward ends of the projections 55 securely.

FIGS. 3-10, 12 illustrate the second exemplary embodiment of the particulate-incorporating attachment 10 of the present invention, which is similar to the first embodiment, but differs in at least that the proximal and distal bracket portions 20, 30 are C-shaped and that the angle between the channel 45 and the flat panel of the implement holder 40 varies in angle from the first embodiment.

FIG. 3 shows an exploded view of the proximal bracket portion 20, distal bracket portion 30 and implement holder 40. As in the first embodiment, the proximal bracket portion 20 includes a panel 21 and a lower flange 25, and the distal bracket portion 30 includes a panel 31 and an upper flange 35. In the second embodiment, the proximal bracket portion 20 further includes an upper flange 25, and the distal bracket portion 30 further includes a lower flange 35. When installed, the flanges 25, 35 of the proximal and distal bracket portions 20, 30 overlap. Specifically, the two upper flanges 25, 35 overlap, and the two lower flanges 25, 35 overlap. Therefore, the heights of the panels 21, 31 must differ sufficiently to allow this overlap. In an example shown in FIGS. 4-5, the height H1 (FIG. 4) of the distal bracket portion 30 is sufficiently greater than the height H2 (FIG. 5) of the proximal bracket portion 20 to permit the proximal bracket portion 20 to be positioned within the flanges 35 of the distal bracket portion 30. It will be apparent that the reverse (H2>H1) would also suitably enable the overlap.

Figure 10:
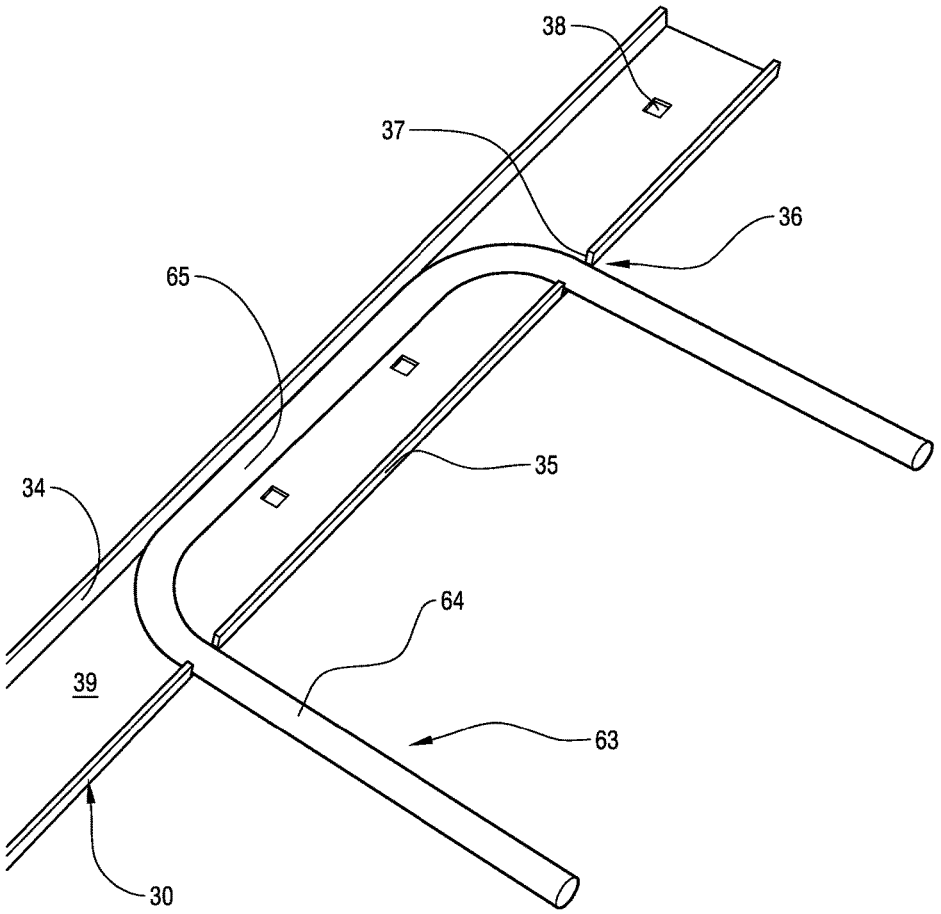
FIG. 10 is an inner perspective view of the distal bracket portion of the second embodiment of the particulate-incorporating attachment of the present invention with a portion of the spreader rest brace inserted, which is an initial step of the installation of the two mount bracket portions over the rest brace to form the completed mount bracket.

As in the first embodiment, the distal bracket upper flange 35 is configured with a pair of notches 36 defined by notch edges 37, with the notches 36 sized and spaced to receive the rest brace extending arms 64, as seen in FIG. 10. In addition, due to the overlapping of the proximal bracket upper flange 25 with the distal bracket upper flange 35, the proximal bracket upper flange 25 comprises a pair of notches 26 defined by notch edges 27 that correspond to the pair of distal bracket upper flange notches 36 and that also receive the rest brace extending arms 64.

In one aspect of the invention, the distal bracket upper flange notch edges 37 may extend past the substantially ninety-degree bend that is created during fabrication of the bend between the upper flange 35 and the panel 31. The continuation of notch edges 37 past the bend and into the panel 31 portion creates a portion of the notch 36 that extends beyond the bend, notch extension 32 defined by notch edges 33, as seen in FIG. 3. Similarly, in the proximal bracket portion 20, the proximal bracket notches 26 may extend beyond the bend between the panel 21 and the upper flange 25 to create notch extensions within the panel 21. Notch extensions are not necessary for the invention, however, due to the imprecision of some of the bending techniques, the extension of the notch edges beyond the bend may provide some advantages to accommodate manufacturing irregularities. For example, if the metal material of the panel 31 is bent with a slightly deeper flange than the specifications stipulate, the inclusion of the notch extensions may facilitate insertion.

Figure 6:
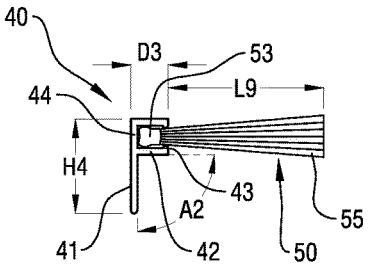
FIG. 6 is an end view of a rake/brush and a first aspect of the implement holder of the second embodiment of the present invention.
Figure 7:
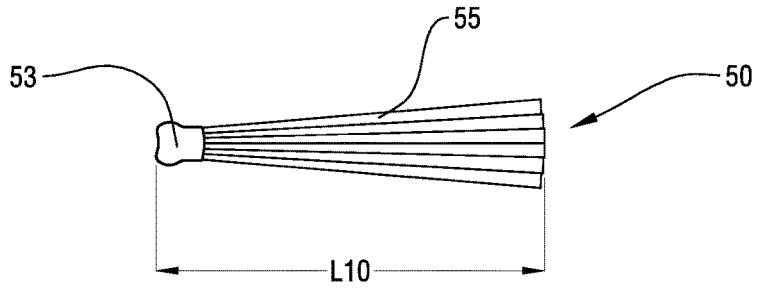
FIG. 7 is an end view of an aspect of the rake/brush of the present invention.

In the aspect of the invention seen in FIG. 6, the angle A2 between the exterior of the channel 45 and the flat plate 41 of the implement holder 40 is approximately ninety-degrees. For at least one conventional model of drop spreader, when angle A2 is ninety-degrees, the rake/brush 50 is positioned at the proper angle for raking or brushing the spreader-dispensed particulates. In other aspects of the invention, other measurements of angle A, may be suitable for other models, depending on factors such as the angle of the drop spreader rest brace 63. However, the size of angle A is typically in the range of 80 degrees to 190 degrees.

The rake/brush 50 of the second embodiment has a binding 53 suitable for carrying the bristles while the rake/brush 50 is being slid into the receiving channel 45, which is sized and configured to receive the binding 53, as seen in FIG. 11. The binding 53 is preferably a metal binding that may be thicker and more robust than the binding 53 in the aspect in which the binding 53 is permanently attached within the channel 45.

Figure 13:
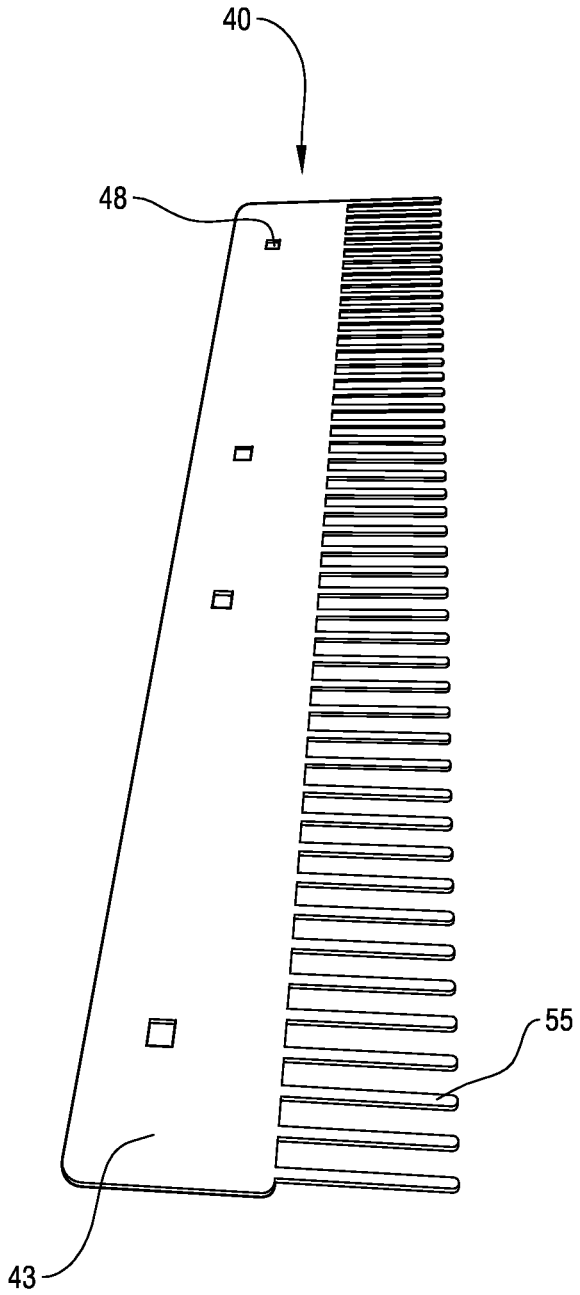
FIG. 13 is a perspective view of an aspect of the present invention, illustrating an integral implement holder and rake/brush with straight projections.
Figure 14:
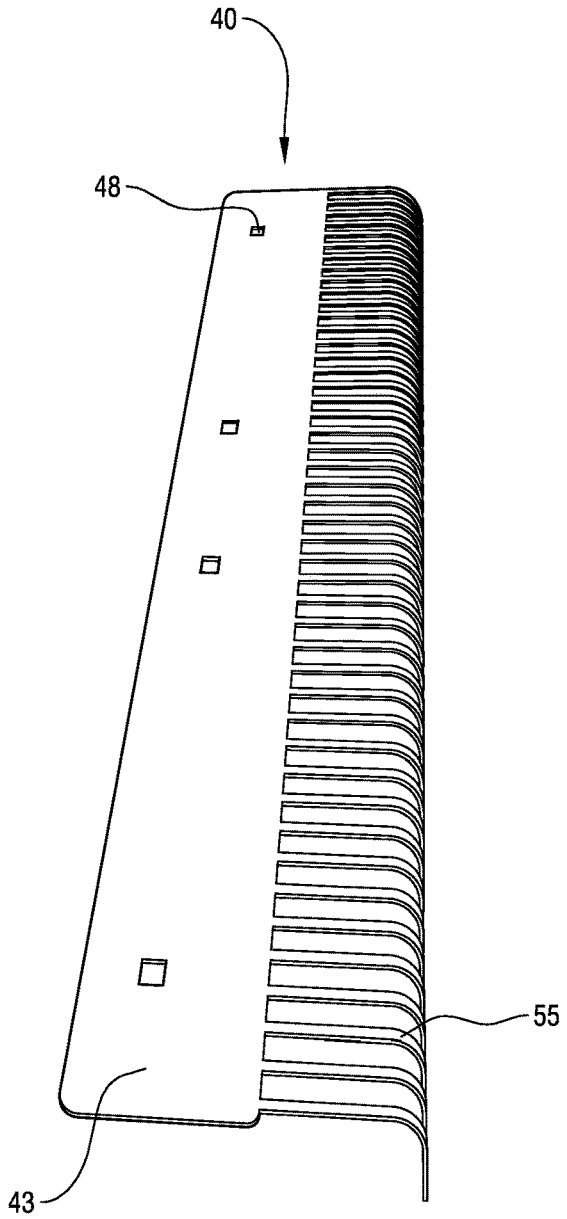
FIG. 14 is a perspective view of an aspect of the present invention, illustrating an integral implement holder and rake/brush with curved projections.

In the third embodiment of FIGS. 13-14, additional aspects of the implement holder 40 and the rake/brush 50 (which may attach to the mounting bracket of either of the first two embodiments) are shown. In both FIGS. 13-14, the implement holder 40 is formed integrally with the rake/brush 50. In another aspect, shown in FIG. 13, the projections 55 are wider than the projections of FIGS. 1-12 and are straight. In another aspect, shown in FIG. 14, the projections 55 are wider than the projections of FIGS. 1-12, but are curved.

In the third embodiment, the implement holder 40 and rake/brush 50 may be formed from a single metal blank, with the projections 55 cut along a longitudinal side and with the holes 48 disposed within the opposing longitudinal side of the blank. Optionally, the longitudinal side including the projections 55 may be reinforced with a second material, such as another sheet of metal or a plastic. The width of the projections 55 of the third embodiment of FIGS. 13-14 may vary from 1/32 inch to 3/8 inch; the length of the projections 55 may vary from 1 to 5 inches.

To attach the particulate-incorporating attachment 10 to a conventional manually powered drop spreader 60, in all embodiments the spreader rest brace 63 is positioned within the interior of the distal bracket portion 30 against the inner surface 39 of the distal bracket portion 30, as seen in FIG. 10. Specifically, the right and left rest brace arms 64 are placed within the right and left notches 36 within the upper flange 35.

In all embodiments, the proximal bracket portion 20 is then brought parallel to the complementary distal bracket portion 30 with the set of proximal bracket holes 28 in alignment with the set of distal bracket holes 38. Additionally, in the second embodiment, the proximal bracket portion 20 is positioned with the right and left notches 26 (within the upper proximal bracket flange 25) aligned with the distal bracket flange notches 36. To complete the mount bracket 15, the proximal bracket portion 20 is then bolted to the distal bracket portion 30 with the rest cross bar 65 captured inside the space between the two mount bracket portions inside the completed bracket.

The implement holder 40 is attached to the exterior of proximal bracket rearward panel 21, by lining up implement holder holes 48 with the proximal bracket holes 22 (when separate bracket holes 22 are to be used, as in FIG. 3) or with proximal bracket holes 28 (when holes 48 are aligned with both holes 28 and 38, as in FIG. 12) and using bolts or other fasteners 12 for joining. (In the aspect in which the implement holder 40 is formed integrally with the proximal bracket portion 20, such as in FIGS. 13-14, this step is not needed.) In the aspects in which the rake/brush 50 is carried by, fixedly attached to, or formed integrally with the implement holder 40 (such as in FIGS. 13-14), this completes the assembly of the particulate-incorporating attachment 10.

In the aspect shown in FIG. 11 in which the rake/brush 50 is removable from the implement holder 40, the rake/brush 50 is then slid into the channel 45 to complete the assembly of the particulate-incorporating attachment 10.

After assembly of the particulate-incorporating attachment 10, the particulate-incorporating attachment 10 is supported by the contained segments (rest brace arms 64 and rest cross member 65) of the rest brace 63. The rest brace cross bar 65 is confined, clamped or otherwise constrained between the bracket portions 20, 30.

To use the particulate-incorporating attachment 10, the user raises the drop spreader 60 to the erect position, causing the ends of the projections 55 of the rake/brush 50 to thereby be positioned downwardly to touch the synthetic grass (or ground). The user pushes the drop spreader 60 forward, and particulates drop downwardly out of the drop spreader bottom opening 67 (FIG. 1) onto the synthetic grass (or ground). The rake/brush 50 follows a few inches behind the dispensed particulates and brushes, rakes, or otherwise incorporates the particulate into the synthetic grass. The dispensing step and incorporating step occur in one operation, taking no more time than the dispensing step alone requires. This significantly reduces the labor required compared to separately dispensing the particulates and then raking in the particulates.

Generally, in the fabrication of the particulate-incorporating attachment 10, each of the two bracket portions 20, 30 and the implement holder 40 will be formed of a sheet metal material. Any ductile metal material may be used, such as steel or aluminum. The thickness of the metal may be from 0.08 to 0.5 mm. Most preferably AISI 1020 cold drawn steel of between 0.09 and 0.20 mm may be used for the mount bracket portions 20, 30. Known metal bending techniques are used in the fabrication of the two bracket portions 20, 30 to form the flanges 25, 35, respectively. Preferably extruded aluminum may be used for the implement holder 40, such as the extrudable aluminum alloy 6063-T5. Optionally, for some applications, the bracket portions 20, 30 and the implement holder 40 may be formed of a man-made material, such as a plastic.

The measurements of the various parts of the particulate-incorporating attachment 10 may vary depending on the model of drop spreader 60 to which it is to be attached and the use or application for which it will be used. However, preferred exemplary measurements are provided that are suitable for a specific design aspect when the particulate-incorporating attachment 10 is to be connected to a specific popular drop spreader model. The height H1 (FIG. 4) of the distal bracket portion 30 may be from 2 to 8 inches, but in the specific design aspect is preferably between 2 and 4 inches, and is most preferably 2.5-3 inches. The depth D1 (FIG. 5) of the flanges of the distal bracket portion 30 may be from 0.4 to 4 inches, but in the specific design aspect is preferably between 0.6 and 1 inches, and is most preferably 0.828 inches. The length L1 (FIG. 8) of the proximal and distal bracket portions 20, 30 may be from 15 inches up to 6 feet, but in the specific design aspect is preferably between 20 and 30 inches, and is most preferably 24 inches. The length L2 (FIG. 8) between the centers of the notches of the proximal and distal bracket portions 20, 30 may be from 8 to 20 inches, but in the specific design aspect is preferably between 10 and 14 inches, and is most preferably 11 inches. The distances L3, L4, L5 (FIG. 8) between the holes in the coordinating bracket portions 20, 30 are not critical, but may be in the range of from 3 to 16 inches. The length L6 (FIG. 9) of the notches 26, 36 in the proximal and distal flanges 20, 30, may be from 0.4 to 3 inches, but in the specific design aspect is preferably between 0.5 and 1.3 inches, and is most preferably 0.9 inches.

The height H2 (FIG. 5) of the proximal bracket portion 20 may be from 2 to 8 inches, but is preferably between 2.0 and 3.0 inches, but in the specific design aspect is preferably between 2 and 4 inches, and is most preferably 2.5-3 inches. The depth D2 (FIG. 5) of the flanges of the proximal bracket portion 20 may be from 0.4 to 4 inches, but in the specific design aspect is preferably between 0.6 and 1 inches, and is most preferably 0.828 inches.

The length L10 (FIG. 7) of the rake/brush 50 may be between 1.5 inches to 10.5 inches, but in the specific design aspect is preferably 2.0 to 3.5 inches, and is most preferably 3 inches.

The height H4 (FIG. 6) of the implement holder 40 may be from 1 up to the height H2 (FIG. 5) of the proximal bracket portion 20, but in the specific design aspect is preferably between 2.0 and 3.0 inches, and is most preferably 2.5-3 inches. The length of the implement holder 40 may be generally equal to the length of the rake/brush 50.

The detailed embodiments of the present invention disclosed herein are merely exemplary of the invention that may be embodied in various and alternative forms. The figures are not necessarily to scale, and some features may be exaggerated or minimized to show details of particular embodiments, features, or elements. Specific structural and functional details, dimensions, shapes, or implementations disclosed herein are not limiting but serve as a basis for the claims and for teaching a person of ordinary skill in the art the described and claimed features of embodiments of the present invention. Therefore, it is intended that the invention not be limited to the particular embodiments disclosed as the best mode contemplated for carrying out this invention, but that the invention will include all the embodiments falling within the scope of the appended claims.

What is claimed is:

1. An attachment for a drop spreader having a drop spreader support rest, said attachment comprising:

a mount bracket comprising a proximal bracket portion connectable to a distal bracket portion; wherein said mount bracket comprises a forward panel, a rearward panel, a first upper flange, and a first lower flange; wherein said first upper flange comprises a right and left set of notch edges defining a right and left set of first upper flange notches; wherein each of said right and left set of first upper flange notches accommodates a segment of said drop spreader support rest;

an implement holder supported by said mount bracket; and a rake/brush supported by said implement holder.

2. The attachment as recited in claim 1, wherein:

said distal bracket portion comprises said forward panel and said first upper flange; and said proximal bracket portion comprises said rearward panel and said first lower flange.

3. The attachment as recited in claim 2, wherein:

said distal bracket portion is C-shaped and further comprises a distal bracket lower flange;

said proximal bracket portion is C-shaped and further comprises a proximal bracket upper flange;

said proximal bracket upper flange comprises two proximal bracket upper flange notch edges defining two proximal bracket upper flange notches; and each of said two proximal bracket upper flange notches accommodates a segment of said drop spreader support rest.

4. The attachment as recited in claim 1, wherein said implement holder is removably attachable to said mount bracket.

5. The attachment as recited in claim 4, wherein:

said rearward panel comprises a set of panel hole edges defining a set of panel holes;

said implement holder comprises a set of implement holder hole edges defining a set of implement holder holes; and said set of implement holder holes are disposed in a location corresponding to the location of said set of panel holes for receiving a fastener to join said implement holder to said proximal bracket portion.

6. The attachment as recited in claim 1, wherein said implement holder is fixedly attached to said mount bracket.

7. The attachment as recited in claim 6, wherein said implement holder is formed integrally with said bracket proximal portion.

8. The attachment as recited in claim 1, wherein said rake/brush is removably attachable to said implement holder.

9. The attachment as recited in claim 8, wherein:

said implement holder comprises a flat panel and a channel extending longitudinally along one side of said flat panel; and said channel is configured to removably receive said rake/brush.

10. The attachment as recited in claim 9, wherein an angle A between said flat panel and the back of said channel is in the range of 80 degrees to 190 degrees.

11. The attachment as recited in claim 1, wherein said rake/brush is formed integrally with said implement holder.

12. The attachment as recited in claim 1, wherein said implement holder is substantially the height of said proximal bracket portion.

13. An attachment for a drop spreader having a drop spreader support rest, said attachment comprising:

a mount bracket comprising a proximal bracket portion and a distal bracket portion;

an implement holder manually attachable to said proximal bracket portion; and a rake/brush manually attachable to said implement holder;

wherein said distal bracket portion comprises a distal forward panel and a distal upper flange; wherein said distal upper flange comprises right and left distal notch edges defining right and left distal bracket flange notches; wherein each of said right and left distal bracket flange notches accommodates a segment of said drop spreader support rest; and wherein said distal forward panel comprises a set of distal bracket hole edges defining a set of distal bracket holes; and wherein said proximal bracket portion comprises a proximal rearward panel and a proximal lower flange; and wherein said proximal rearward panel comprises a set of proximal bracket hole edges defining a set of proximal bracket holes; wherein said set of proximal bracket holes are disposed in a location corresponding to the location of said set of distal bracket holes; and wherein said proximal bracket holes and said distal holes cooperate to receive a fastener to join said proximal bracket portion to said distal bracket portion around said segment of said drop spreader support rest.

14. The attachment for a drop spreader, as recited in claim 13 wherein:

said distal bracket portion is C-shaped and further comprises a lower distal flange; and said proximal bracket portion is C-shaped and further comprises a proximal bracket upper flange; wherein said proximal bracket upper flange comprises two proximal bracket upper flange notch edges defining two proximal bracket upper flange notches that each accommodate a segment of said drop spreader support rest.

15. The attachment for a drop spreader, as recited in claim 13 wherein said implement holder is configured with a set of implement holder hole edges defining a set of implement holder holes disposed in a location corresponding to the location of said set of proximal bracket holes for attaching said implement holder to said proximal rearward panel.

16. The attachment for a drop spreader, as recited in claim 13 wherein said implement holder is formed integrally with said bracket proximal portion.

17. The attachment for a drop spreader, as recited in claim 13 wherein:

said implement holder comprises a flat panel and a channel extending longitudinally along the lower side of said flat panel; and said channel is sized and shaped to accommodate said rake/brush.

18. The attachment for a drop spreader, as recited in claim 13 wherein said rake/brush comprises multiple projections and a binding that secures said multiple projections together.

19. The attachment for a drop spreader, as recited in claim 13 wherein said multiple projections comprise nylon bristles.

20. An attachment for a drop spreader having a drop spreader support rest, said attachment comprising:

a mount bracket comprising a proximal bracket portion and a distal bracket portion; wherein said distal bracket portion comprises a distal forward panel and a distal upper flange; wherein said distal upper flange comprises a right and left set of distal notch edges defining right and left distal bracket flange notches; wherein each of said right and left notches accommodates a segment of said drop spreader support rest; wherein said distal forward panel comprises a set of distal bracket hole edges defining a set of distal bracket holes; wherein said proximal bracket portion comprises a proximal rearward panel and a proximal lower flange; and wherein said proximal rearward panel comprises a set of proximal bracket hole edges defining a set of proximal bracket holes; wherein said set of proximal bracket holes correspond to the set of proximal bracket holes for receiving a fastener to join said proximal bracket portion to said distal bracket portion around said segment of said drop spreader support rest;

an implement holder attachable to said proximal bracket portion; wherein said implement holder is configured with a set of implement holder hole edges defining a set of implement holder holes that correspond to said set of proximal bracket holes for attaching said implement holder to said proximal rearward panel; and a rake/brush attachable to said implement holder; wherein said rake/brush comprises a binding and multiple projections; wherein said implement holder comprises a flat panel and a channel extending longitudinally along the lower longitudinal side of said flat panel; wherein said channel has a base wide enough to accommodate said binding.

* * * * *